US007173605B2

(12) United States Patent
Fong et al.

(10) Patent No.: US 7,173,605 B2
(45) Date of Patent: Feb. 6, 2007

(54) METHOD AND APPARATUS FOR PROVIDING PROJECTED USER INTERFACE FOR COMPUTING DEVICE

(75) Inventors: Jun Tung Fong, Pleasantville, NY (US); Richard H. Boivie, Monroe, CT (US)

(73) Assignee: International Business Machines Corporation, Armonk, NY (US)

( * ) Notice: Subject to any disclaimer, the term of this patent is extended or adjusted under 35 U.S.C. 154(b) by 450 days.

(21) Appl. No.: 10/622,656

(22) Filed: Jul. 18, 2003

(65) Prior Publication Data

US 2005/0012721 A1 Jan. 20, 2005

(51) Int. Cl.
*G09G 5/00* (2006.01)

(52) U.S. Cl. ..... 345/168; 341/22

(58) Field of Classification Search ..... 345/156–158, 345/168–172, 1.1, 1.2, 4–6; 341/22; 715/773; 353/39; 359/196, 460, 443, 449, 451, 453, 359/456, 459, 454; 352/61, 63, 114
See application file for complete search history.

(56) References Cited

U.S. PATENT DOCUMENTS 4,575,722 A * 3/1986 Anderson ..... 345/86
6,266,048 B1 7/2001 Carau, Sr.
6,323,942 B1 11/2001 Bamji
6,614,422 B1 * 9/2003 Rafii et al. ..... 345/168
6,937,210 B1 * 8/2005 MacDonald ..... 345/1.1
2004/0125147 A1 * 7/2004 Liu et al. ..... 345/773

OTHER PUBLICATIONS

NEC Corporation & NEC Design, Ltd., "Design Activity: Future Design", Apr. 19, 2003, http://web.archive.org/web/20030419040033/http://www.nec-design.co.jp/showcase/.*

* cited by examiner

*Primary Examiner*—Amr A. Awad
*Assistant Examiner*—Stephen Sherman
(74) *Attorney, Agent, or Firm*—Douglas W. Cameron; Ryan, Mason & Lewis, LLP

(57) ABSTRACT

Apparatus and techniques for providing a user interface for a computing device such as a pervasive computing device. The computing device projects a user input display from a projector onto a surface. A user output display is projected from the projector of the computing device onto a surface. The user input display and the user output display may be projected from the same projector. The user input display and user output display may be projected on different surfaces. A single projected image may be split and directed with a mirror system.

24 Claims, 4 Drawing Sheets

METHOD AND APPARATUS FOR PROVIDING PROJECTED USER INTERFACE FOR COMPUTING DEVICE

FIELD OF THE INVENTION

The present invention is related to apparatus and techniques for projecting user interfaces for computing devices such as pervasive computing devices and, more particularly, for projecting a user input display and a user output display.

BACKGROUND OF THE INVENTION

Pervasive computing devices such as PDAs (personal digital assistants), pocket PCs (personal computers), tablet PCs, and smart camera/PDA phones have steadily increased in popularity. Chip technology has made it possible for these devices to be small but functionally powerful. However, due to the decreased size of the devices, there is little to no room for a keyboard, and most include a tiny display.

The addition of a virtual keyboard image for input and/or a virtual display for user output has been proposed as a way to attempt to improve the usability and portability of these pervasive computing devices. For example, U.S. Pat. No. 6,323,942 discloses a virtual keyboard. Further, U.S. Pat. No. 6,266,048 discloses a virtual display/keyboard for a PDA, which provides a solution to the limitations caused by the size of the pervasive computing device. A keyboard image is projected on a surface close to the user and a display image is projected on the same surface between the virtual keyboard image and the projecting device. While this increases the size of both the keyboard image and the display, the placement of both images on the same surface is uncomfortable for the user because the user must look downward to read the user output display. This is not the customary placement for a computer screen and a user would have to become accustomed to the new placement. The system of U.S. Pat. No. 6,266,048 also uses a first projector for the keyboard image, and a second projector for the display.

The above mentioned approaches fail to provide a system that produces an optimal ergonomic and economic virtual input and output. Thus, a need exists for an improved virtual input and output system which overcomes these and other limitations.

SUMMARY OF THE INVENTION

The present invention provides apparatus and techniques for projecting user interfaces for computing devices such as pervasive computing devices and, more particularly, for projecting a user input display and a user output display.

For example, in one aspect of the invention, a technique of providing a user interface for a computing device comprises the following steps. A user input display is projected from a projector of a computing device on a first surface, while a user output display is projected from a projector of a computing device on a second surface. The first surface and the second surface are disposed in different planes.

Advantageously, the technique enables the projection of the user input display on a separate surface from the user output display. This is accomplished through the use of a mirror system in the computing device which splits a single projected image into the user input display and the user output display. The user input display may be projected on a flat horizontal surface between the user and the computing device, while the user output display may be projected on a vertical surface behind the computing device. This allows a user to remain in a comfortable and customary position when the computing device is used, while maintaining the benefit of increased size of both the input and output displays.

In a second aspect of the invention, a technique of providing a user interface for a computing device comprises the following steps. A user input display is projected from a projector of a computing device onto a surface, while a user output display is projected from the projector onto the same surface. A single projector is used for both the user input display and the user output display. Additionally, typing feedback may be emitted when a keystroke is detected on the user input display or virtual keyboard image. This feedback may be in an audio and/or a visual format.

These and other objects, features, and advantages of the present invention will become apparent from the following detailed description of illustrative embodiments thereof, which is to be read in connection with the accompanying drawings.

DETAILED DESCRIPTION OF PREFERRED EMBODIMENT

As will be illustrated in detail below, the present invention introduces apparatus and techniques for projecting user interfaces for computing devices. A user input display may be projected on a first surface while a user output display may be projected on a second surface using a single projector of a pervasive computing device. The user input display is preferably a virtual keyboard image. By "virtual" keyboard it is meant, a projected image on a surface that resembles a keyboard and performs the same functions as a keyboard with the assistance of a keystroke detection system. While embodiments refer to "pervasive" computing devices, the invention is not limited thereto, and could be implemented with other computing devices that would benefit from the use of virtual input/output devices.

Figure 1:
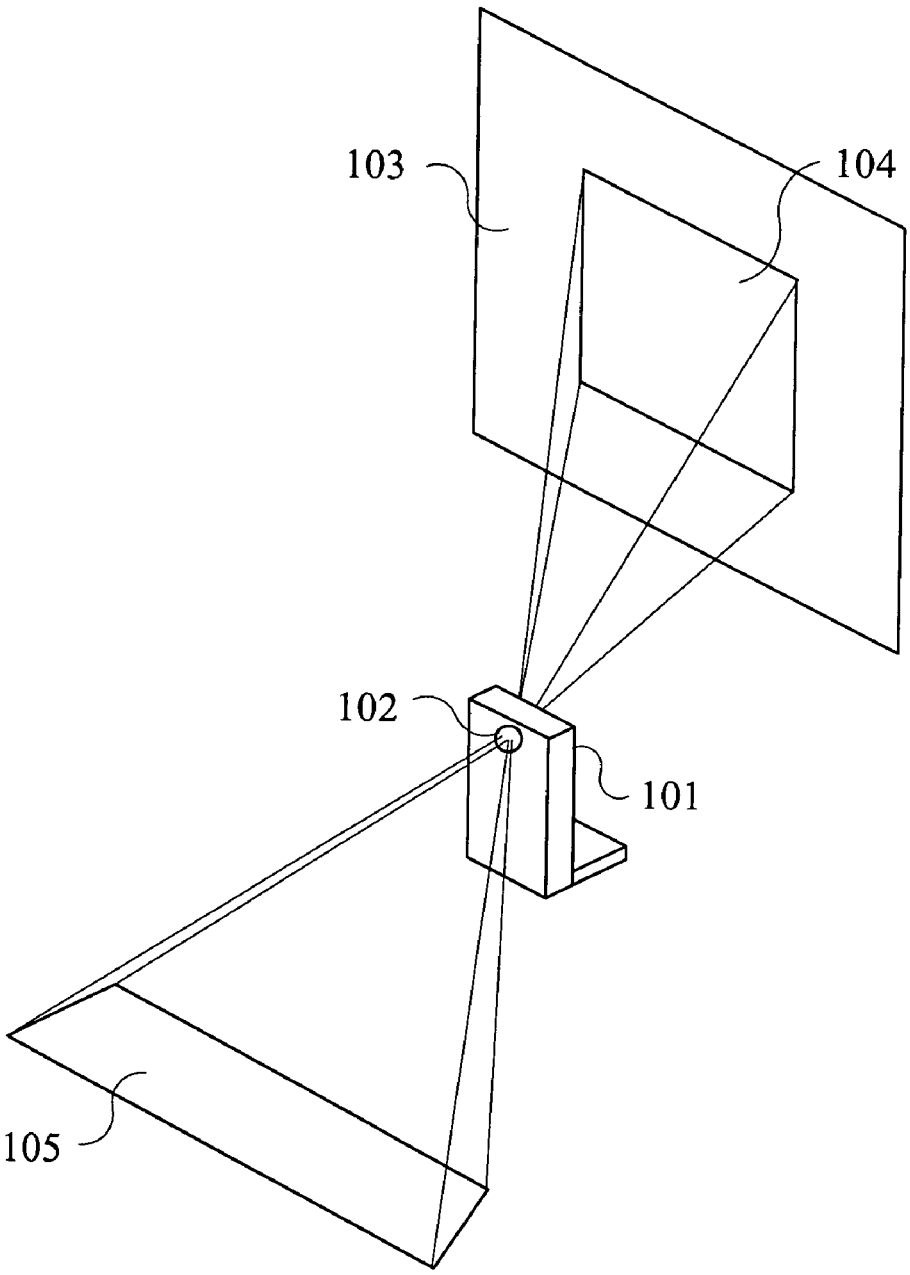
FIG. 1 is a diagram illustrating a pervasive computing device projecting a user input display and a user output display on separate surfaces, according to an embodiment of the present invention.

Referring initially to FIG. 1, a diagram illustrates a pervasive computing device projecting a user input display and a user output display on separate surfaces, according to an embodiment of the present invention. A pervasive computing device 101 projects a virtual keyboard image 105 on a first surface in front of pervasive computing device 101, and between pervasive computing device 101 and the user. A user output display image 104 is projected behind pervasive computing device 101 onto a flat vertical surface 103. The first surface is preferably disposed in a plane perpendicular to the second surface. A single micro projector 102 is used with a mirror system (not shown but to be described in detail in accordance with FIG. 2) to reflect user output display image 104 to the rear and project virtual keyboard image 105 in front of the user. A multiple projector system may also be used to create the two images on separate surfaces. Virtual keyboard image 105 may also comprise a virtual scratch pad or other pointing device. An example of one of several micro projectors is a projection system using the Texas Instruments Digital Micro mirror Display (DMD).

Figure 2:
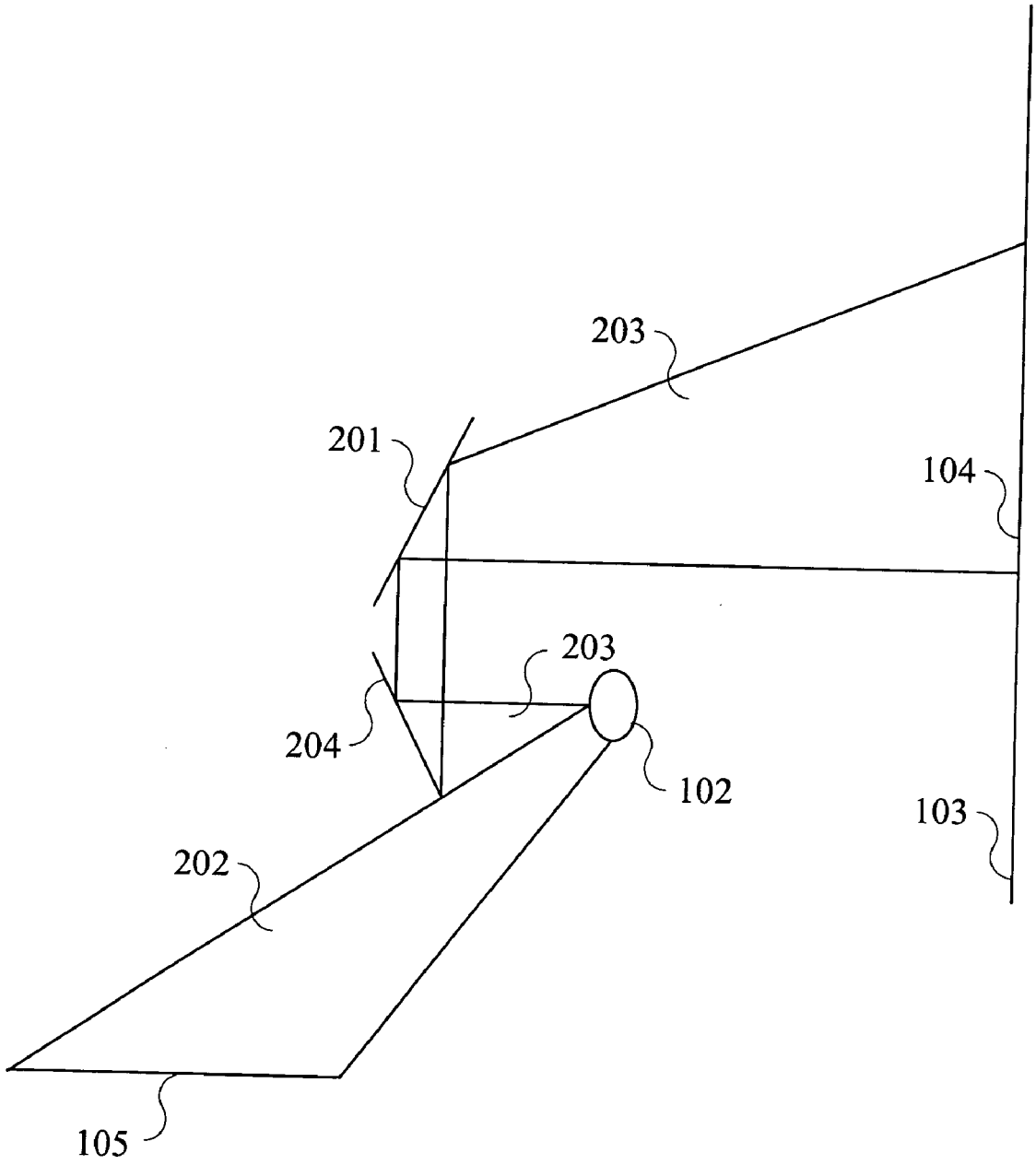
FIG. 2 is a diagram illustrating a mirror system, a micro projector and the resulting split image in the pervasive computing device, according to an embodiment of the present invention.

Referring now to FIG. 2, a diagram illustrates a mirror system, a micro projector, and the resulting split image in the pervasive computing device, according to an embodiment of the present invention. It is to be appreciated that the mirror system and micro projector may be integral with the computing device. The image from micro projector 102 comprises virtual keyboard image 105 in its lower portion 202, and user output display image 104 in its upper portion 203. A lower mirror 204 of the mirror system catches upper portion 203 and reflects it to an upper mirror 201, which projects user output display image 104 onto rear surface 103. Lower portion 202 is projected, without interference from mirror system 201, 204, in front of pervasive computing device 101.

In operation, lower portion 202 of the projected image with virtual keyboard image 105 is superimposed on a keystroke detection system (not shown). This keystroke detection system is well known in the art and is described in U.S. Pat. No. 6,266,048, which is incorporated herein by reference. This system involves laser beams emitted from pervasive computing device 101 across virtual keyboard image 105, substantially parallel to the surface to which virtual keyboard image 105 is projected. When the laser beams are interrupted over a virtual key of virtual keyboard image 105 and this interruption is detected by a sensor, input is created for processing by the pervasive computing device. It is to be appreciated, however, that the invention is not limited to use with any particular keystroke detection system.

Virtual keyboard image 105 simulates a regular physical keyboard for good ergonomics. Upper portion 203 of the projected image is the same as an image that would normally be displayed on a computer screen. Upper portion 203 is also in a location where a user would look if working with a traditional computer screen. In addition to the advantage of using only a single projector, the mirror system is also designed so that a larger image may be produced even when a short distance exists between the pervasive computing device and the vertical display surface. The size of the projected image depends on the total distance from micro projector 102 to lower mirror 203, upper mirror 201 and vertical display surface 103. Because of the folding effect of the mirror system, the size of this projected image is larger than if the image is projected from the micro-projector directly to the display surface. Further enlargement of the projected image is possible if the distance between the projector and the mirror system is adjustable.

Figure 3:
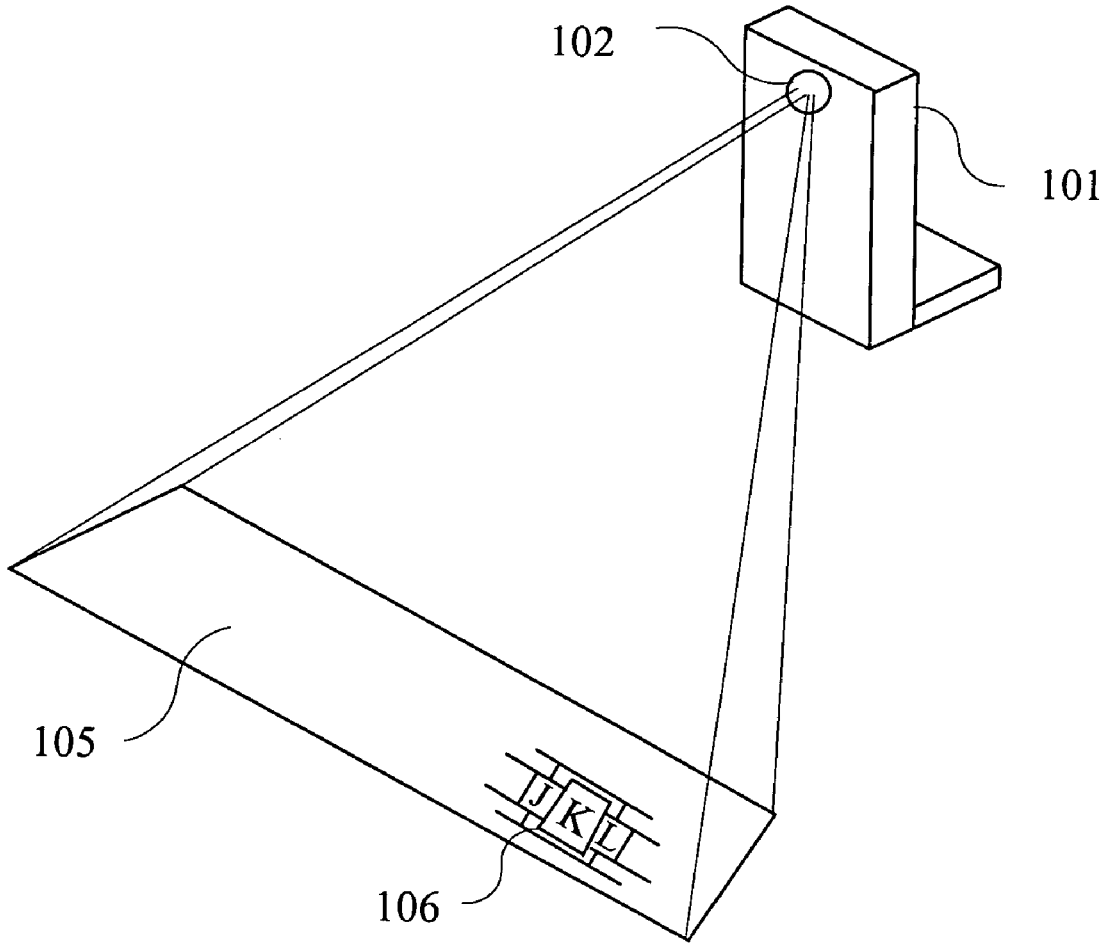
FIG. 3 is a diagram illustrating a pervasive computing device projecting a user input display and key feedback, according to an embodiment of the present invention.

Referring now to FIG. 3, a diagram illustrates a pervasive computing device projecting a user input display and keystroke feedback, according to an embodiment of the present invention. An additional improvement of the present invention is the addition of typing feedback when a key stroke is detected by the keystroke detection system. This feedback may be a configurable audio click or a visual display on either virtual keyboard image 105 or user output display 104. Informing the user that a key 106 has been input is necessary since the lack of real keys leaves the user uncertain as to whether a key stroke was entered into the system. This visual and/or audible feedback permits the user to quickly recognize whether the desired input was created. Audible feedback may be in the form of a click or beep emanating from pervasive device 101. Visual feedback may be the changing of the color or the shape of key 106 on virtual keyboard image 105. Changing the shape of key 106 may include enlarging the key as shown in FIG. 3. Visual feedback may also include displaying an indicating symbol on user output display 104. It is to be appreciated that the present invention is not limited to the type of mechanism used to provide keystroke feedback.

This feedback technique may be incorporated into pervasive computing device 101 as a software application. The feedback mechanism may also be implemented by a circuit or a controller configurable for providing the functions described.

Figure 4:
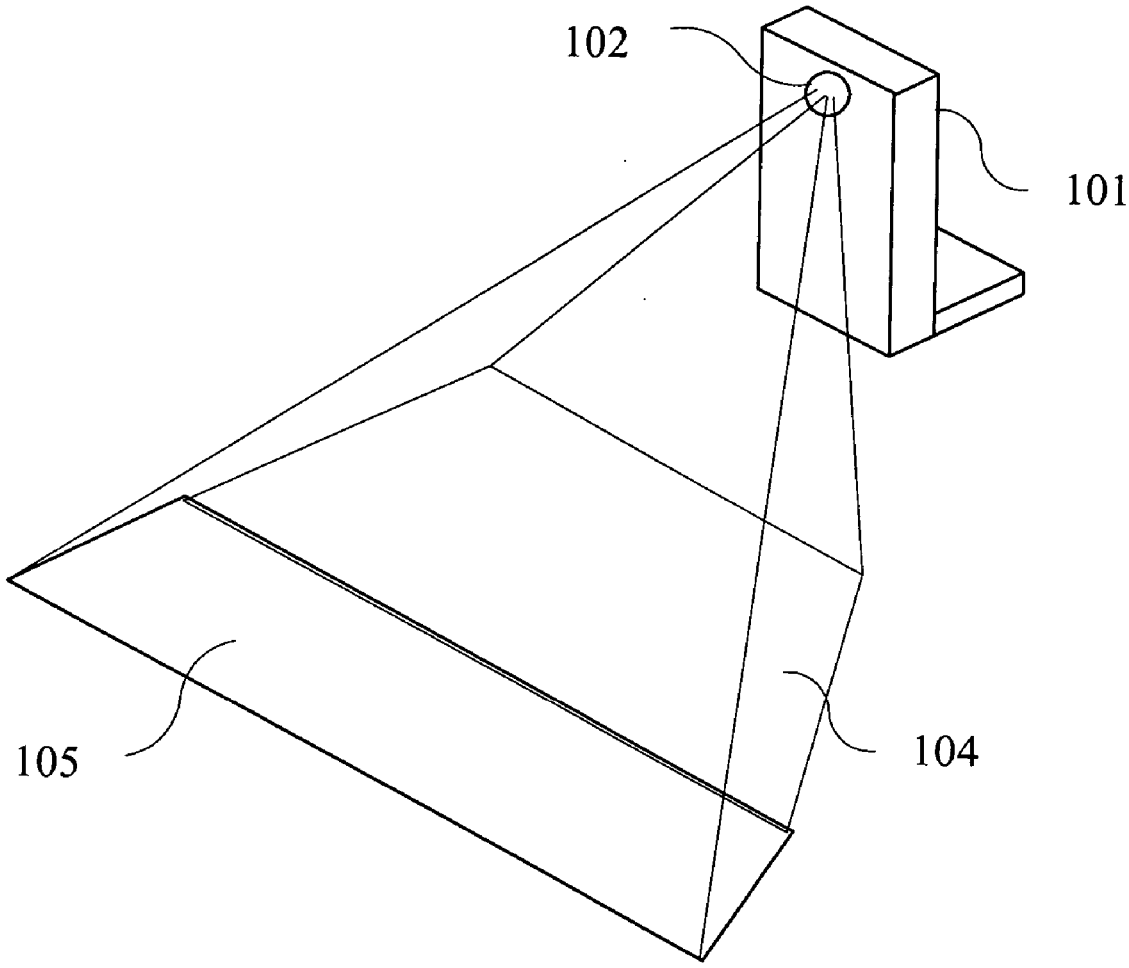
FIG. 4 is a diagram illustrating a pervasive computing device projecting a user input display and a user output display on a single surface in front of the user, according to an embodiment of the present invention.

Referring now to FIG. 4, a diagram illustrates a pervasive computing device projecting a user input display and a user output display on a single surface in front of the user. This embodiment is a front projection system. Advantageously, the configuration of the present invention uses a single projector. Virtual keyboard image 105 is projected close to the user and user output display image 104 is projected between virtual keyboard image 105 and pervasive computing device 101. The front projection system may also project user output display image 104 on a separate surface and different plane than virtual keyboard image 105. For example, user output display image 104 may be displayed on a wall behind the user for presentation purposes, while pervasive computing device 101 and virtual keyboard image 105 remain in front of the user. In such an instance, pervasive computing device 101 may be elevated by a tripod so that the user is not in the path of projection of output display image 104. A keystroke detection system and typing feedback can also be applied with this system.

Accordingly, as described herein, the present invention provides apparatus and techniques for projecting user interfaces for computing devices such as pervasive computing devices and, more particularly, for projecting a user input display and a user output display. In one aspect of the invention, the user input display and the user output display are projected on different surfaces. Other aspects of the invention include the use of a single projector and the emission of feedback when a keystroke is detected on the virtual keyboard image. The inventive apparatus and techniques for providing a projected user interface are applicable to a large number of applications such as PDAs, pocket PCs, tablet PCs, and smart camera/PDA phones.

Although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A method of providing a user interface for a computing device, comprising the steps of:

projecting a user input display and a user output display as a single image from a single projector:

reflecting a portion of the single image with a mirror system in the computing device, which causes the splitting of the originally projected single image into the user input display and the user output display;

projecting the user input display onto a first surface; and projecting the user output display onto a second surface, wherein the first surface and the second surface are disposed in different planes.

2. The method of claim 1, wherein the computing device is a pervasive computing device.

3. The method of claim 1, wherein, in the step of reflecting a portion of the originally projected single image, a reflected portion of the image is the user output display and an unreflected portion of the image is the user input display.

4. The method of claim 1, wherein the step of reflecting a portion of the originally projected single image further comprises:

splitting the user output display from the user input display with a first mirror of the mirror system;

receiving a reflection of the user output display from the first mirror at a second mirror of the mirror system; and projecting the user output display from the second mirror to the second surface.

5. The method of claim 1, wherein the step of projecting the user output display comprises projecting a large image from the mirror system when a short distance exists between the computing device and the second surface.

6. The method of claim 1, wherein the projector is a micro projector.

7. The method of in claim 1, wherein the first surface is in a plane disposed in front of the computing device, the second surface is in a plane disposed behind the computing device, and the second surface is orthogonal to the first surface.

8. The method of claim 1, wherein the user input display comprises an image of a keyboard.

9. The method of claim 1, wherein the first surface is a horizontal surface and the second surface is a vertical surface.

10. The method of claim 1, further comprising the step of providing audio feedback from the computing device in response to intercepting sensors of a virtual keystroke detection system, over a virtual key in the user input display.

11. The method of claim 1, further comprising the step of providing visual feedback on the user output display in response to intercepting sensors of a virtual keystroke detection system, over a virtual key of the user input display.

12. The method of claim 1, further comprising the step of providing visual feedback on the user input display in response to intercepting sensors of a virtual keystroke detection system, over a virtual key of the user input display.

13. The method of claim 1, wherein the user input display comprises an image of a scratch pad.

14. The method of claim 1, wherein the user input display comprises an image of a pointing device.

15. A computing device, comprising:

a projector that projects an image; and a mirror system disposed in accordance with the projector, wherein the mirror system reflects a portion of the image from the projector, which causes the splitting of the projected image into a user input display and a user output display, projecting a nonreflected portion of the image to a first surface and a reflected portion of the image to a second surface, wherein the first surface and the second surface are disposed in different planes, and wherein the projected reflected portion of the image and the projected nonreflected portion of the image provide a virtual user interface for the computing device.

16. The computing device of claim 15, wherein the computing device is a pervasive computing device.

17. The computing device of claim 15, wherein the mirror system comprises:

a first mirror that intercepts a portion of the image from the projector; and a second mirror that receives the reflected portion of the image from the first mirror and projects the reflected portion of the image to the second surface.

18. The computing device of claim 15, wherein the projector is a micro projector.

19. The computing device of claim 15, wherein the nonreflected portion of the image is projected in front of the computing device between the computing device and the user.

20. The computing device of claim 15, wherein the reflected portion of the image is projected behind the computing device.

21. The computing device of claim 15, wherein the first surface is perpendicular to the second surface.

22. The computing device of claim 15, wherein the nonreflected portion of the projected image comprises a virtual keyboard image.

23. The computing device of claim 15, wherein the reflected portion of the projected image comprises a user output display.

24. The computing device, of claim 15, further comprising a key feedback mechanism.

* * * * *